US006363766B1

(12) United States Patent
Kunze

(10) Patent No.: US 6,363,766 B1
(45) Date of Patent: Apr. 2, 2002

(54) DOUBLE FUNCTION BENDING BLADE FOR SHEET METAL BENDING MACHINE

(75) Inventor: Wolfgang Kunze, Leonding (AT)

(73) Assignee: Salvagnini Italia S.p.A. (IT)

( * ) Notice: Subject to any disclaimer, the term of this patent is extended or adjusted under 35 U.S.C. 154(b) by 0 days.

(21) Appl. No.: 09/547,069

(22) Filed: Apr. 10, 2000

(30) Foreign Application Priority Data

May 14, 1999 (IT) ..... MI99A1058

(51) Int. Cl.[7] ..... B21D 5/04
(52) U.S. Cl. ..... 72/306; 72/316; 72/323
(58) Field of Search ..... 72/323, 322, 306, 72/312, 316, 379.2, 315

(56) References Cited

U.S. PATENT DOCUMENTS

| | | | | | |
|---|---|---|---|---|---|
| 3,983,735 | A | * | 10/1976 | Berry | 72/312 |
| 4,091,652 | A | * | 5/1978 | Wilcox | 27/315 |
| 4,356,716 | A | | 11/1982 | Aschauer | 72/322 |
| 5,941,116 | A | * | 8/1999 | Kunze | 72/306 |

FOREIGN PATENT DOCUMENTS

| | | | | |
|---|---|---|---|---|
| EP | 0 567 193 | | 10/1993 | |
| EP | 0 679 455 | | 11/1995 | |
| EP | 0 679 456 | | 11/1995 | |
| FR | 686651 | * | 7/1930 | 72/323 |
| GB | 929840 | * | 6/1963 | 72/306 |
| JP | 56-77031 | * | 6/1981 | 72/306 |
| JP | 4-190925 | * | 7/1992 | 72/306 |
| JP | 6-198342 | * | 7/1994 | 72/316 |

* cited by examiner

*Primary Examiner*—Daniel C. Crane
(74) *Attorney, Agent, or Firm*—Akerman Senterfitt

(57) ABSTRACT

There is described a new bending blade for sheet metal bending machine, that in order to allow the bending of the sheet metal both upward and downward comprises two bending teeth extending from a single body of blade in directions orthogonal to each other. One of the two teeth extends substantially upward for the execution of upward bending, while the other tooth extends substantially in horizontal direction for the execution of downward bending.

4 Claims, 3 Drawing Sheets

DOUBLE FUNCTION BENDING BLADE FOR SHEET METAL BENDING MACHINE

DESCRIPTION

The present invention concerns a double function bending blade for sheet metal bending machine.

For the bending of the edges of panels of sheet metal, bending machines are commonly used in which the edge of the sheet metal to be submitted to bending is pressed between a fixed bending counter blade and a mobile blank holder above it.

The bending operation of the edge of the sheet metal is carried out by a bending device that has one or more mobile bending blades according to whether the machine is destined to the bending in one or two opposite senses, that is upward and/or downward.

Object of the present invention is to realize a bending blade that is made up in such a way as to be able to carry out bendings of the edge of the sheet metal in opposite senses and therefore to allow the provision of a single blade bidirectional bending machine.

According to the invention such object is attained with a bending blade characterized in that it comprises two bending teeth extending from a single blade body in directions substantially orthogonal to each other.

One of the two teeth is destined to the bending of the sheet metal in one sense, for example upward, while the other tooth allows the bending in the other sense, for example downward. A double function bending blade is thus obtained, that is capable to carry out bendings both upward and downward.

If, as preferable, one of the teeth extends in a direction substantially parallel to the sheet metal resting plane, the same tooth can also be used to cause the squeezing of the sheet metal edge previously folded upward over a further back portion of the same sheet metal, resting on the counter blade.

The characteristics and the advantages of the present invention will be made evident from the following detailed description of an embodiment thereof that is illustrated as a non limiting example in the enclosed drawings, in which.

Figure 1:
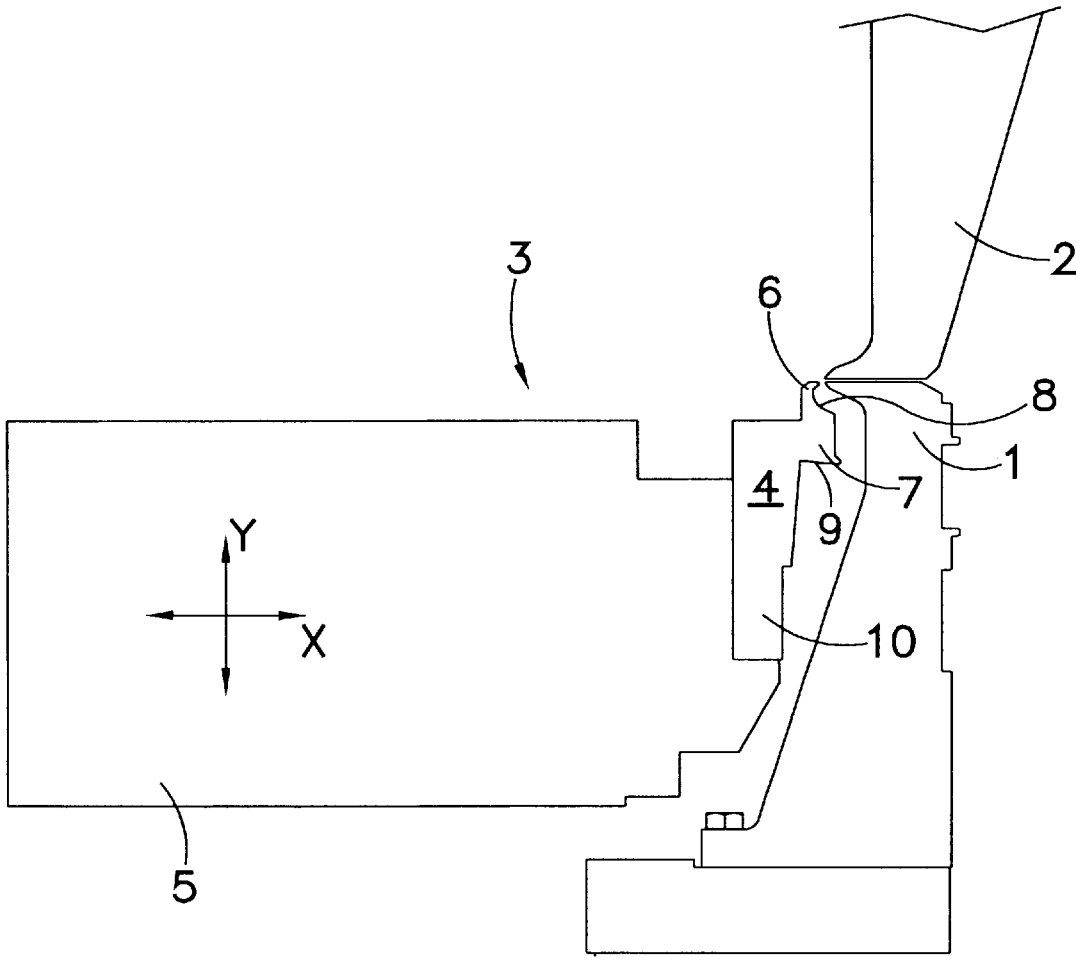
FIG. 1 shows schematically the assembly of the sheet metal locking and bending unit of a sheet metal bending machine that utilises a bending blade according to the present invention.

In FIG. 1 there is schematically shown a sheet metal bending unit that comprises a fixed counter blade 1, a blank holder 2 that is vertically movable toward and away from the counter blade 1 and a bending device 3 comprising a bending blade 4 fixed to a blade holder 5 that is movable in combined motion in the directions X and Y of FIG. 1 through control means not shown in the drawings.

The bending blade 4 provides two separate bending teeth 6 and 7, the first one extending upward for the execution of the upward bending and the second one extending in substantially horizontal direction for the execution of the downward bending. The tooth 6 has an essentially vertical extension with a concave recess 8 facing toward the counter blade-blank holder unit, while the tooth 7 forms a substantially horizontal step 9 with the body 10 of the blade 4.

During operation, the edge to be bent of a sheet metal 11 is squeezed between the counter blade 1 and the blank holder 2 and by suitable displacement of the blade holder 5 one of the two bending teeth 6 and 7 is brought in engagement with the sheet metal edge as to cause its bending.

Figure 2:
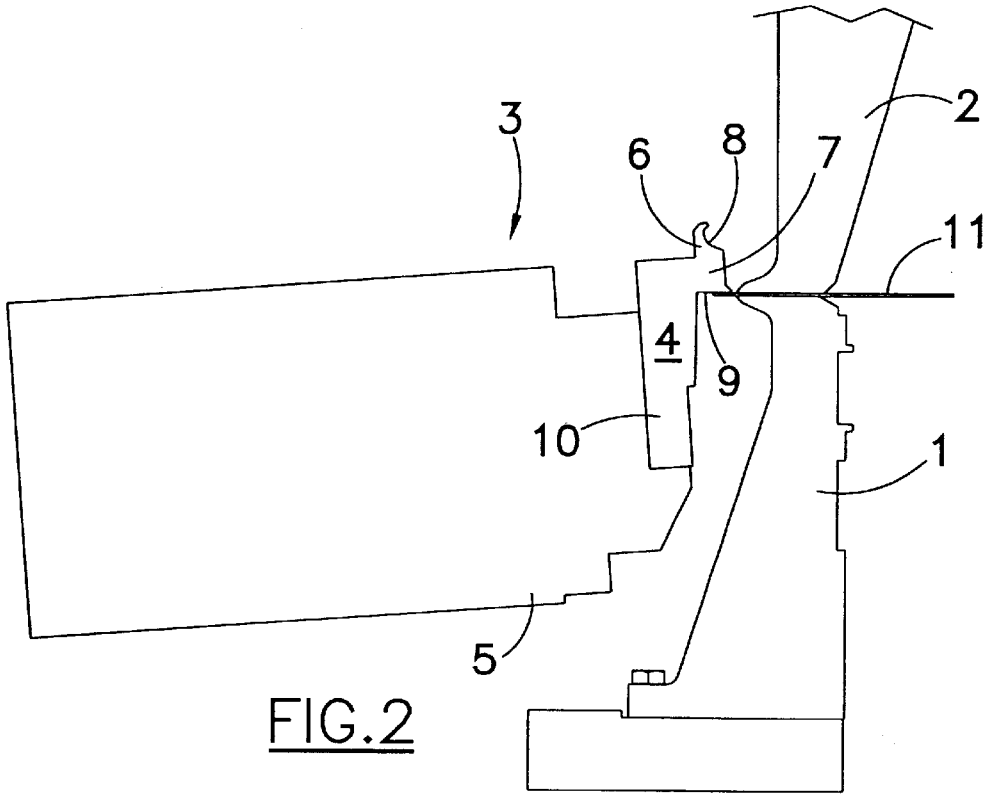
FIGS. 2–5 show the same assembly in various working positions.
Figure 3:
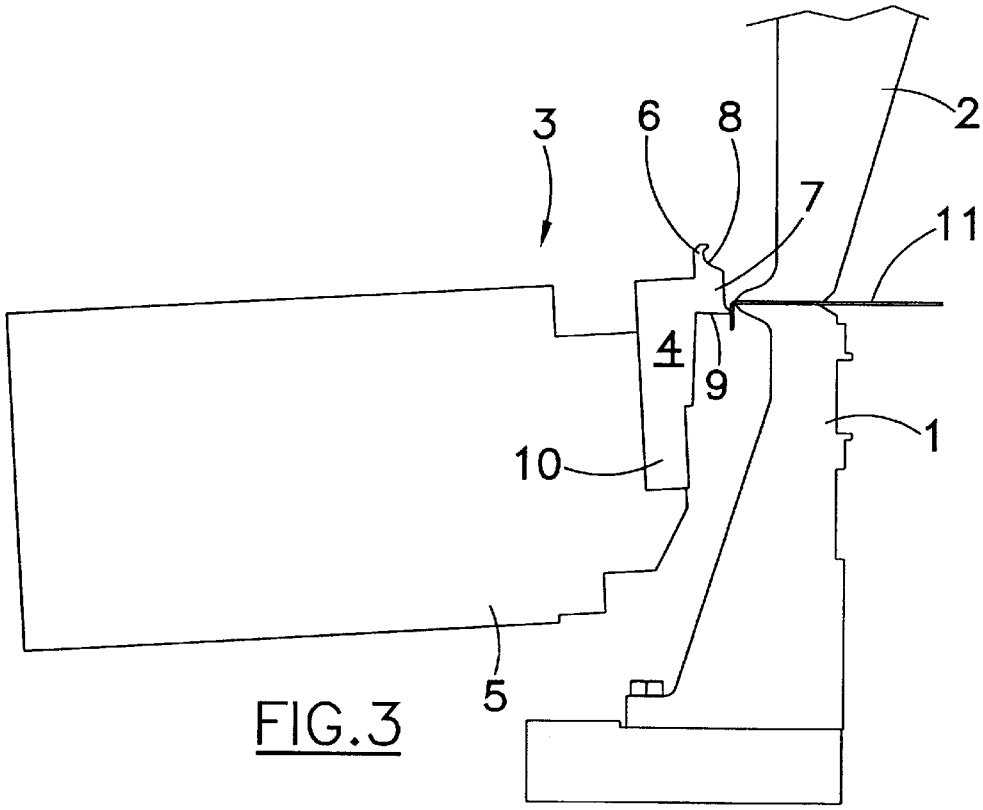
Figure 4:
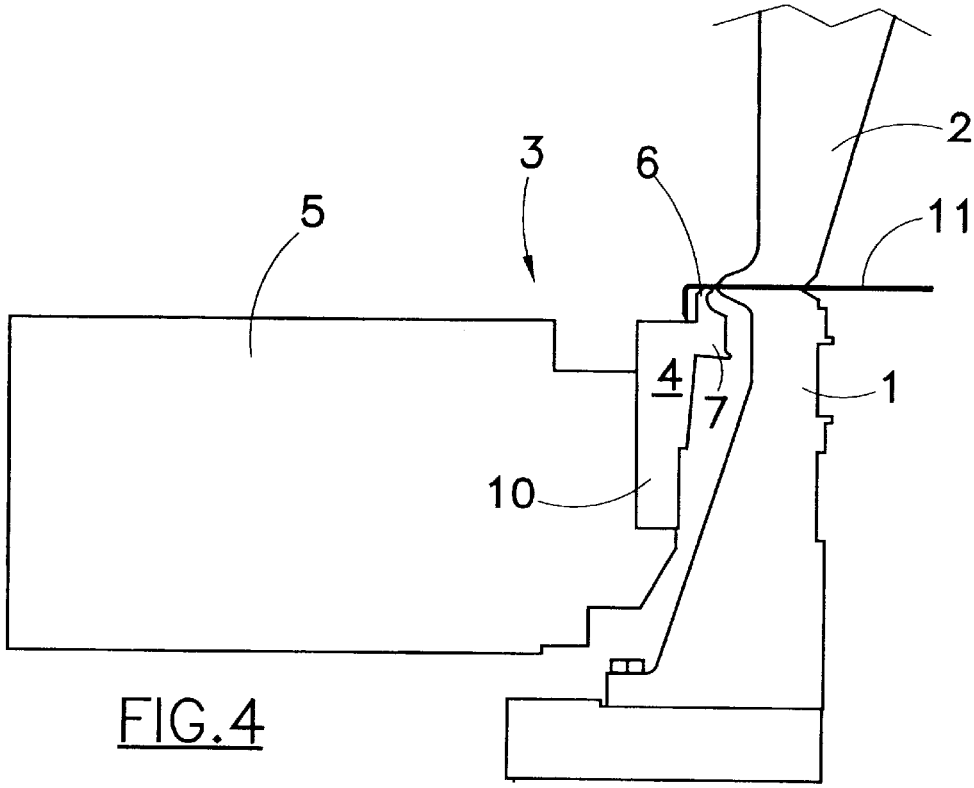
Figure 5:
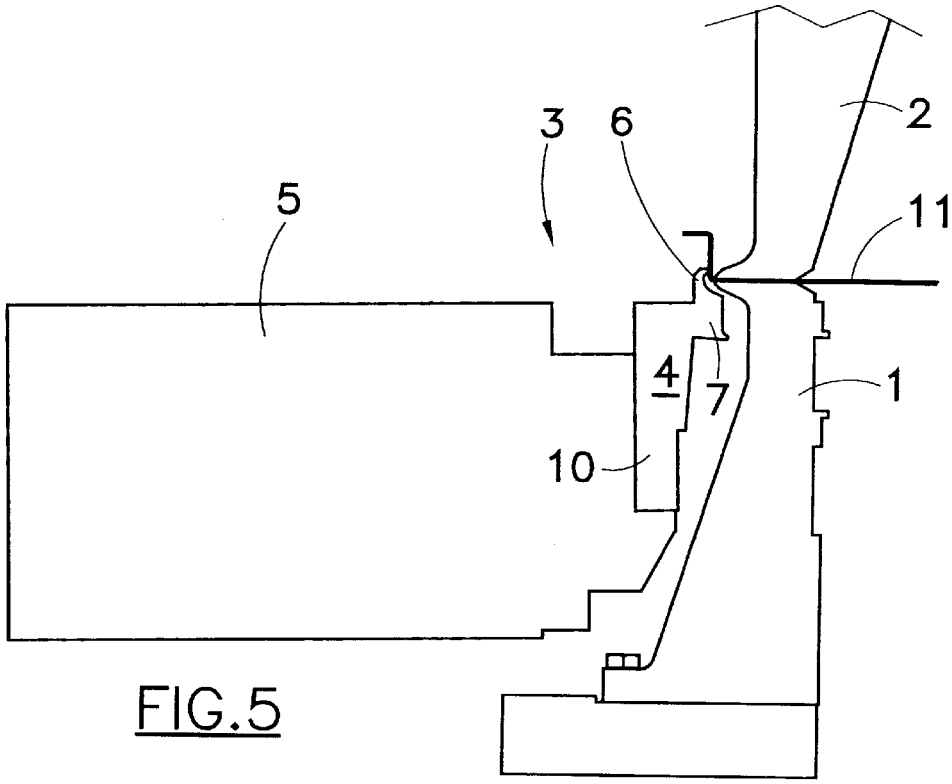

In the case shown in FIG. 2, the horizontal tooth 7, and more precisely its horizontal step 9, is for instance engaged with the sheet metal edge and moved vertically downward in order to cause its bending downward at 90°, as shown in FIG. 3, and then the vertical tooth 6 of the same blade 4 is engaged with a further back portion of the same edge of the sheet metal (FIG. 4) in order to cause, by vertical movement upward, a subsequent upward bending of the sheet metal at 90°, as shown in FIG. 5.

If desired, by combining the two vertical movements of the blade 4 with a limited horizontal movement of the same being suitably commanded to the blade holder 3, it is possible to carry out sheet metal bendings at angles higher than 90°, in particular, for the tooth 6, by taking advantage of the concavity 8 that is provided in the same tooth.

Finally, supposing instead to have first utilised the vertical tooth 6 in order to cause upward bending of the edge of the sheet metal at more than 90°, the horizontal tooth 7 can subsequently be used, once the blank holder has been lifted, in order to carry out the complete squeezing of the folded edge of the sheet metal onto the immediately following portion of the same sheet metal, resting on the counter blade 1. To such purpose the horizontal step 9 is preferably slightly tilted, as shown in the drawings, or otherwise provided with a slight concavity in order to receive the curve of the sheet metal.

Of course the use of a lower blade as the one according to the invention does not prevent the simultaneous use of a traditional upper blade. In such case the tooth 7 of the lower blade is used only to carry out the squeezing of the sheet metal, when desired, while the downward bending of the sheet metal is entrusted to an appropriate tooth of the upper blade.

I claim:

1. A sheet metal bending machine, comprising:

a fixed counter-blade;

a mobile blank holder which is movable towards the counter-blade to lock a planar portion of the sheet metal thereon;

a bending blade holder and a bending blade fixedly supported thereby;

said bending blade holder being movable in perpendicular and parallel directions with respect to the locked planar portion of sheet metal to cause the bending blade to engage the sheet metal in order to bend a peripheral edge of the sheet metal;

wherein said bending blade has a single blade body provided with bending teeth fixed relative to each other which extend therefrom in respective directions substantially perpendicular to each other in order to cause bending of the sheet metal edge, one of the teeth extending so as to bend the sheet metal perpendicular to the locked planar portion with the bend extending in one direction and the other tooth extending so as to bend the sheet metal perpendicular to the locked planar portion in a direction opposite to the one direction.

2. The bending-machine according to claim 1, wherein one of said teeth extends substantially upward for the execution of upward bending, while the other tooth extends substantially in a horizontal direction for the execution of downward bending.

3. The bending machine according to claim 2, wherein said upwardly extending tooth has a concavity facing toward the edge of the sheet metal for the execution of bending with angle greater than 90°.

4. The bending machine according to claim 2, wherein said horizontally extending tooth forms a substantially horizontal step with the body of the blade.

* * * * *